US012433397B2

(12) United States Patent
Gold et al.

(10) Patent No.: US 12,433,397 B2
(45) **Date of Patent: *Oct. 7, 2025**

(54) MODULAR APPARATUS AND ELEMENTS THEREOF

(71) Applicant: Gold & Levy Inc., Skokie, IL (US)

(72) Inventors: Gil Gold, Kibutz Shalavin (IL); Tamir Levy, Efrat (IL)

( * ) Notice: Subject to any disclaimer, the term of this patent is extended or adjusted under 35 U.S.C. 154(b) by 394 days.

This patent is subject to a terminal disclaimer.

(21) Appl. No.: 18/095,370

(22) Filed: Jan. 10, 2023

(65) Prior Publication Data

US 2023/0147856 A1 May 11, 2023

Related U.S. Application Data

(62) Division of application No. 17/711,253, filed on Apr. 1, 2022, now Pat. No. 11,576,484.

(51) Int. Cl.
*A47B 13/00* (2006.01)
*A47B 3/06* (2006.01)

(52) U.S. Cl.
CPC ..... *A47B 13/003* (2013.01); *A47B 3/06* (2013.01)

(58) Field of Classification Search
CPC ... A47B 13/003; A47B 13/06; A47B 87/0207; A47B 87/0246
See application file for complete search history.

(56) References Cited

U.S. PATENT DOCUMENTS

| | | | | | |
|---|---|---|---|---|---|
| 2,615,770 | A * | 10/1952 | Curtis | A47B 3/06 | 248/165 |
| 2,656,045 | A * | 10/1953 | Curtis | A47B 3/06 | 108/159 |
| 5,289,784 | A * | 3/1994 | Waibel | A47B 13/02 | 248/371 |
| 6,659,022 | B1 * | 12/2003 | Holtz | A47B 3/06 | 108/50.01 |
| 6,971,529 | B1 * | 12/2005 | Shapiro | A47B 81/002 | 211/DIG. 1 |
| 11,576,484 | B2 * | 2/2023 | Gold | G09G 3/3677 | |
| 2003/0205180 | A1 * | 11/2003 | Bishop | A47B 13/003 | 108/157.17 |
| 2021/0227971 | A1 * | 7/2021 | Kourieh | A47B 3/06 | |

* cited by examiner

*Primary Examiner* — Daniel J Rohrhoff
(74) *Attorney, Agent, or Firm* — Aronberg Goldgehn Davis and Germisa

(57) ABSTRACT

The present system is directed to a modular apparatus that may be assembled and disassembled repeatedly without the use of tools. The modular system includes connectors that may be fixed to the underside of a plank and then engaged with leg portions. The connectors further include channels to accommodate retention members of additional attachments, such as covers, guards, signage, or racks that may be added onto the modular apparatus to increase its utility. The retention members mate with the connectors to connect and securely hold the attachment and can be removed from the connectors all without the need for tools.

5 Claims, 8 Drawing Sheets

MODULAR APPARATUS AND ELEMENTS THEREOF

CROSS-REFERENCE TO RELATED APPLICATIONS

This application claims priority to and incorporates by reference in its entirety and for all purposes U.S. patent application Ser. No. 17/711,253 filed on behalf of Gil Fold and Tamir Levy on Apr. 1, 2022, U.S. patent application Ser. No. 17/144,386 filed on behalf of Gil Gold and Tamir Levy on Jan. 8, 2021 and U.S. Provisional Patent Application Ser. No. 62/964,402 filed on behalf of Gil Gold and Tamir Levy on Jan. 22, 2020.

BACKGROUND

It is common practice for the hospitality industry to set up temporary work stations, such as a breakfast buffet line. The work stations may be equipped with a variety of add-ons, such as shelving, shielding, and signage. Mobile, modular, and collapsible tables are well known in the industry. However, such work stations are generally simple tables with collapsible legs. Table cloths and Velcro® skirts are usually used to hide the legs, and add-ons are generally bolted or clamped (such as using C-clamps) to the table top. The table cloths tend to oversized, easily soiled, especially close to the ground, and can easily be dislodged. The clamps and bolts are cumbersome and susceptible to being lost. Accordingly, there is a need for a user friendly and toolless design for a modular work station system that can be efficiently assembled, disassembled, and placed on movable storage carts.

SUMMARY

The present modular system is comprised of sets of legs, table tops and add-ons that easily connect together without the need for tools to form a sturdy work station and serving platform.

As used herein the term "permanent" is meant to encompass anything that is designed to be repeatedly connected and disconnected without the use of tools. Thus, two devices that are glued or welded together are permanently connected. Two items that are nailed or screwed together are also permanently connected. However, two items that are connected by friction, hook-and-loop fastener, or snaps, for example, are merely connected together or engaged.

As used herein, legs, or leg portions, generally refer to support structures for raising and maintaining other pieces of the assembly off of the ground. The assembled modular apparatus may be referred to as a display, serving station, work station, or table, though such references are intended to be used solely for reference purposes, are not limiting, and merely refer to a use for the modular apparatus. Similarly, the attachment surfaces may be referred to as table tops, shelves, surfaces, or planks, again as non-limiting descriptions. While the attachment surfaces may be flat, they can be constructed in a variety of manners to form whatever surface shape may be necessary for a particular use. For example, a surface may be corrugated, ribbed, smooth, rough, have inlays of other materials, be uniform or not, have holes, groves, or carvings, or exhibit other shapes (such as geometric shapes including but not limited to square, triangle, oval, circular, pentagon, etc.) that will be apparent to one of ordinary skill in the art. The planks may be made of any suitable material for forming a surface, for example, wood, bamboo, plastic, laminate, metal, etc. In addition to the legs and planks, other attachments may be connected to the modular system as will be described in more detail herein.

The present system is characterized by multiple independent leg portions and separate attachment members (such as planks) that may be connected in a variety of manners to form modular work or staging surfaces. The legs and planks may be repeatedly connected and disconnected so that the modular apparatus may be assembled and used, then disassembled and placed on carts and either moved or stored. The assembly and disassembly processes may be accomplished without tools or additional fasteners. Different shaped planks may be used with the same leg portions such that differing shapes of work surfaces may be constructed. Attachments may further be added or removed to form alternate configurations.

The bottom of the attachment members are provided with one or more connectors. The connectors may be placed so as to align with the legs and thereby prevent the attachment member from sliding along the legs. The connectors may also include one or more cavities. The cavities exhibit a unique configuration that corresponds to a portion of an add-on, such as a shield. The portion of the shield is adapted to slide into and be retained by the cavity of the connector. In that way the add-on may be securely, albeit temporarily, engaged with the work station and serving area. The connectors are generally female and the add-ons generally include a male prong. The male prong slides into the female connector and engages with it. The prongs and connectors may be repeatedly engaged and disengaged by workers without the need or use of tools.

DETAILED DESCRIPTION OF EMBODIMENTS

Figure 1:
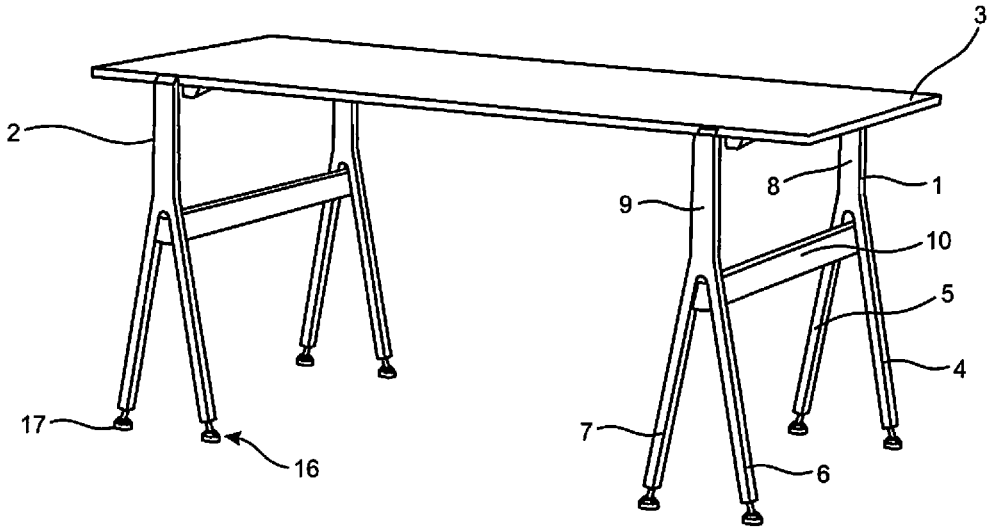
FIG. 1 is a perspective view of an assembled modular apparatus.

Throughout the specification, wherever practicable, like structures will be identified by like reference numbers. In some figures, components, such as additional connectors or fasteners have been omitted for clarity in the drawings. Unless expressly stated otherwise, the term "or" means "either or both" such that "A or B" includes A alone, B alone, and both A and B together. Unless stated specifically otherwise, the term "length" refers to the longer side of an object while the term "width" refers to the shorter side of an object regardless of orientation of the object.

Although the present invention has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

Figure 2A:
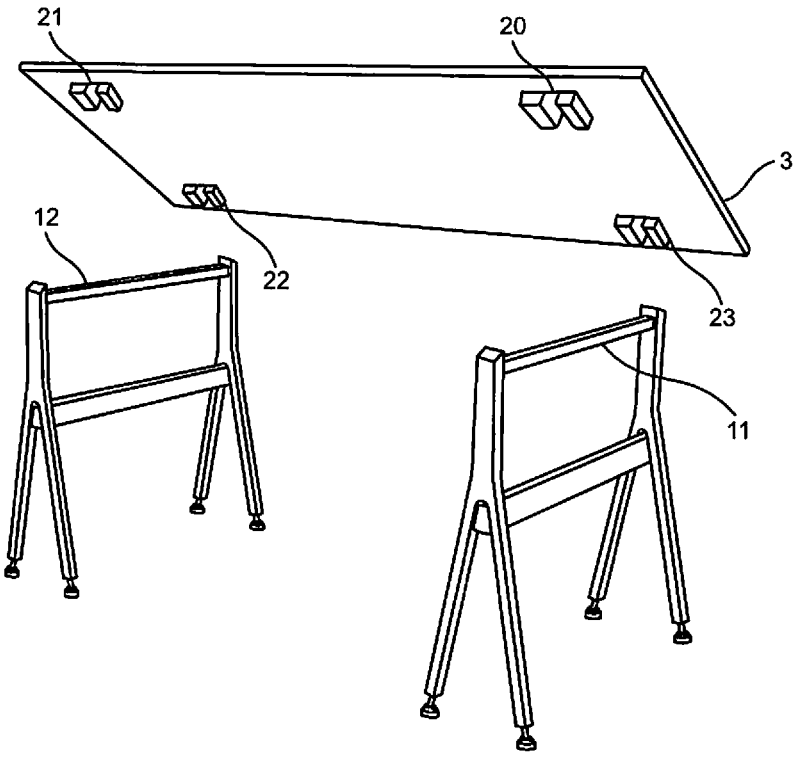
FIG. 2A is a perspective view of the legs and top of a modular apparatus in a separated state.

FIG. 1 depicts an embodiment utilizing two leg portions 1, 2, and a single plank 3. The leg portions may be formed of a single material or be a composite. For example the legs could be formed of molded plastic, circular, square, or hexagonal metal or carbon fiber tubes. Another embodiment utilizes metal, such as aluminum square stock, steel, stainless steel, or other metal that may be welded (or otherwise connected or formed) to the appropriate shape and connected (or formed) together with a cross piece. Additionally the legs could be made of a combination of materials. As shown in FIGS. 1 and 2A, the legs 1 may be formed of four struts, 4, 5, 6, 7, and two extensions 8, 9, each connected to two of the struts. The struts and extension are also connected together by cross pieces 10, 11. In one embodiment, the legs may further be equipped with leveler feet 16, 17 that may be adjustable.

In one embodiment, the top portions of the cross pieces are flat or otherwise shaped to mate with the underside of a plank to be placed over top of the cross pieces. In one embodiment, the extensions 8 and 9 include upper protrusions that extent above the top portion of the cross piece 12 (see FIG. 2A). The upper protrusions may have dimensions that are approximately the thickness of a plank, and may operate to prevent the plank from sliding along or off the cross piece 12. Alternately, the tops of extensions 8 and 9 may be the same height as the top of the crosspiece and the edge of plank may overlay or extend beyond the legs. In such an embodiment, the connectors, discussed in more detail herein, may be positioned on the bottom of the plank such that they abut the extensions and thereby assist in preventing the plank from sliding along the crosspiece.

Figure 2B:
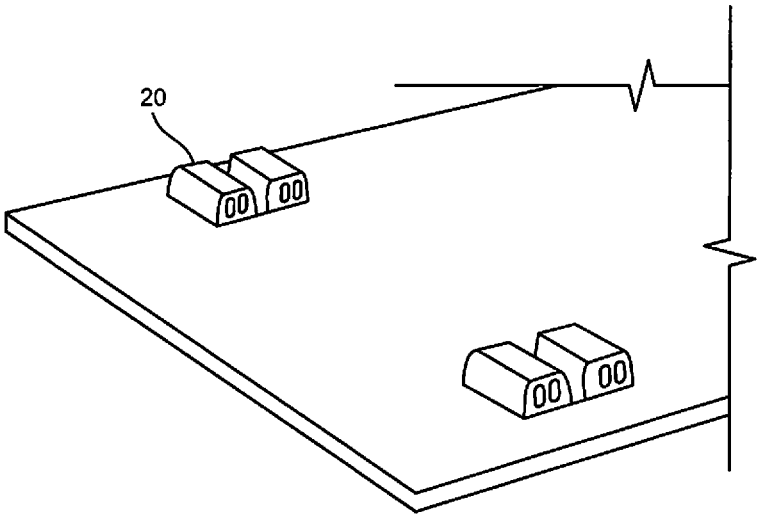
FIG. 2B is a perspective view of the top of a modular apparatus with connectors.

As shown in FIGS. 2A-2B, the underside of a plank 3 includes at least one connector 20. In the embodiment of FIG. 2A, the plank 3 includes four connectors 20, 21, 22, 23. Connectors 20 and 23 are aligned to mate with the crosspiece 11, and connectors 21 and 22 are aligned to mate with the crosspiece 12. The connectors may be made of sturdy material, such as rubber, plastic, resin, metal, or wood. In one embodiment, the connectors are injection molded plastic. In one embodiment the connector may be made of ABS with 30% glass fiber that may be coated, or at least partially covered, with TPU (thermoplastic polyurethane). The connectors may include a central channel that corresponds to the crosspiece such that when the plank and connectors are overlaid on the crosspiece, the connectors engage the crosspiece and thereby prevent the plank from sliding front to back or side to side along the crosspiece.

An exemplary connector is shown in six different orientations in FIGS. 7A-7F. The connector 100 includes a mounting surface 101 that mates with the underside of a plank, two raised bumpers 102, 103 forming a channel 104 there between with bumper 103 forming channel sidewall 105 and bumper 102 forming channel sidewall 106 each connected by channel base 107. In one embodiment, one or more of the channel sidewalls 105 and 106 and the channel base 107 is formed of, or provided with, a resilient material that may also have a high coefficient of friction. For example, the connector may be made of molded plastic, and overlaid on the sidewalls 105 and 106 and the channel base 107 may be a resilient rubber material, which may further be corrugated to provide additional frictional engagement between the connector and the crosspiece. Forming the bumpers and channel as a single integrated piece helps prevent wear on the bottoms of the planks and assists in alignment of the bumpers on the bottoms of the planks. It is contemplated that the portion forming the surface 107 and extending to surface 101 may be relatively thin so as to provide structural support between the bumpers and a surface that can wear overtime, but do so while remaining efficient in the amount of material needed to form the connector. For example that portion of the connector may between 0.25 inches and 0.0625 inches. However, it is conceivable that it could be thicker or thinner. It is contemplated that the connector raised bumpers could be entirely separate from one another, such that the channel is formed by the sidewalls of the bumpers and a bottom surface of a plank.

Figure 7A:
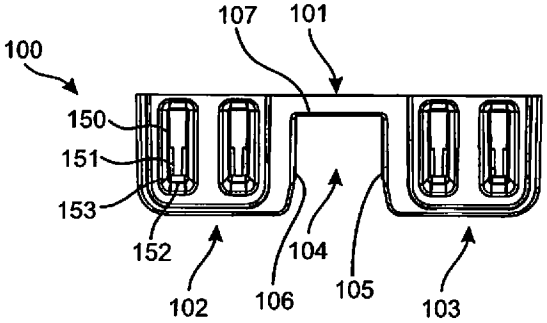
FIG. 7A is a front plan view of a connector.
Figure 7B:
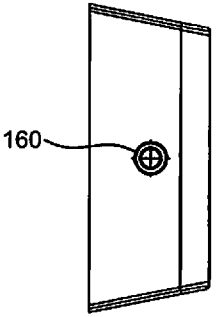
FIG. 7B is a side plan view of a connector.
Figure 7C:
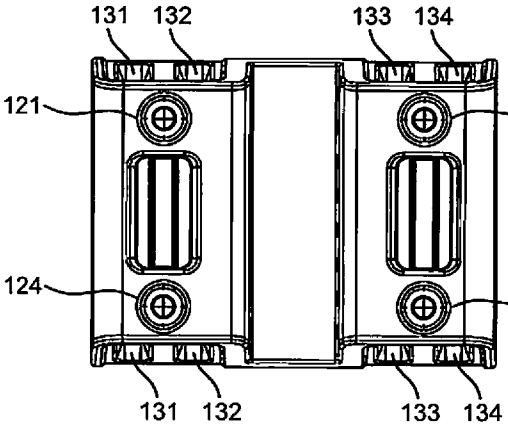
FIG. 7C is a bottom plan view of a connector.
Figure 7D:
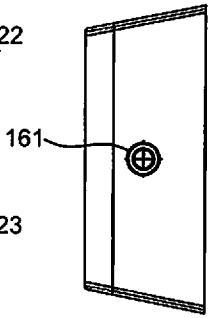
FIG. 7D is a side plan view of a connector.
Figure 7E:
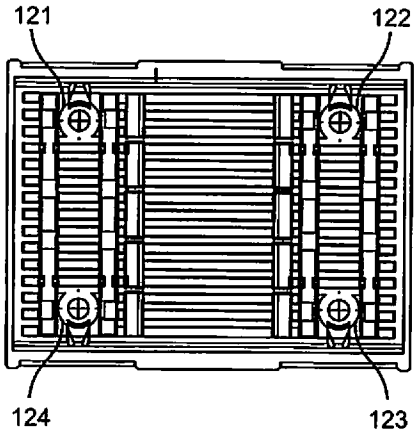
FIG. 7E is a top plan view of a connector.
Figure 7F:
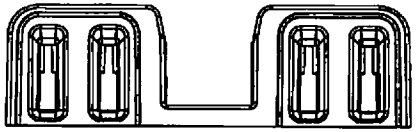
FIG. 7F is a back plan view of a connector.

The connector may be affixed to a plank. In one embodiment the connectors are glued to the plank. In another embodiment the connectors are connected to the plank by fasteners, such as rivets, nails, or screws. The connectors may include one or more mounting holes. FIGS. 7C and 7E depict an embodiment including four mounting holes 121, 122, 123, 124. The mounting holes may traverse the thickness of the connector such that a screw may be inserted into a mounting hole and further screwed into the bottom of a plank. The planks may also include threaded anchors and the connectors may be screwed or bolted into the threaded anchors. In one embodiment, the connectors are fastened to the underside of the plank such that the fasteners do not penetrate the topside of the plank. This allows the topside of the plank to remain uniform in texture and appearance. It also allows any plank to be used as the upper most plank as all planks may be made uniform.

Figure 8:
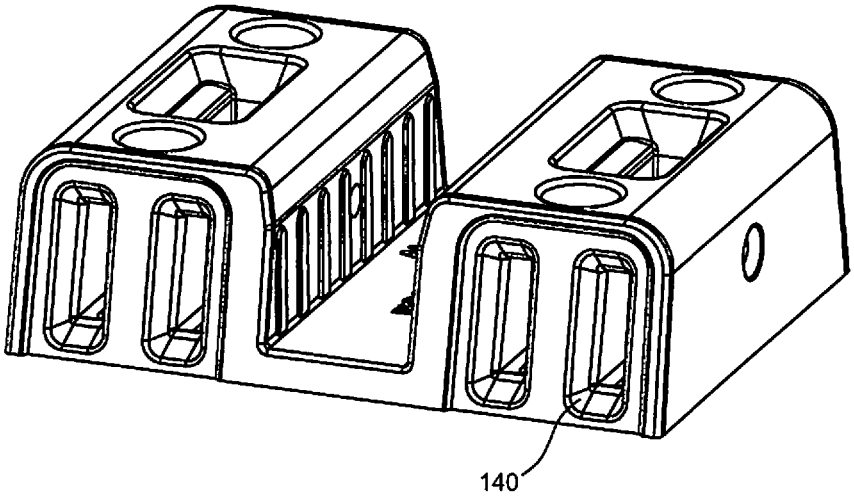
FIG. 8 is a perspective view of a connector.

The connector also includes at least one slot. In one embodiment, the connector includes four slots 131, 132, 133, 134, though more or less could be utilized. The slots may be open at one end and closed at the other. However, in the embodiment depicted in FIGS. 7A-7F, the slots traverse the entire length of the connector such that each slot forms a cavity within the connector. In one embodiment the outer terminus of each slot is chamfered as shown generally with reference to outer terminus 140 in FIG. 8. While the shape of the slots is depicted as generally oval, other shapes, such as round, square, triangular, etc. could be utilized.

The interior of each slot may be of uniform dimensions. In other embodiments, the interior of a slot may be shaped. For example, the upper portion 150 of the interior of a slot may have a first width, while at least a part of the length of the lower portion 151 of the interior of the slot may have a second width that is less than the first width. The base 152 of the interior of a slot may be uniform. In another embodiment the base 152 of the interior of a slot may include one or more detents carved (or molded) into the base or raised above the base. In one embodiment, the connector may be injection molded such that there exist holes within the slots forming channels to the outside of the connector. The connector may then be covered, or coated, in a second material, such as TPU that is extruded partially into the interior of the slots through the channels and holes. The extrusions may then solidify to form one or more detents within the slot. In FIG. 7A, one example of a raised detent 153 is shown. It should be appreciated that the foregoing structure could be inverted such that the interior of the slot is narrower in a top portion and having detents formed in a top surface of the interior of the slot.

Figure 3A:
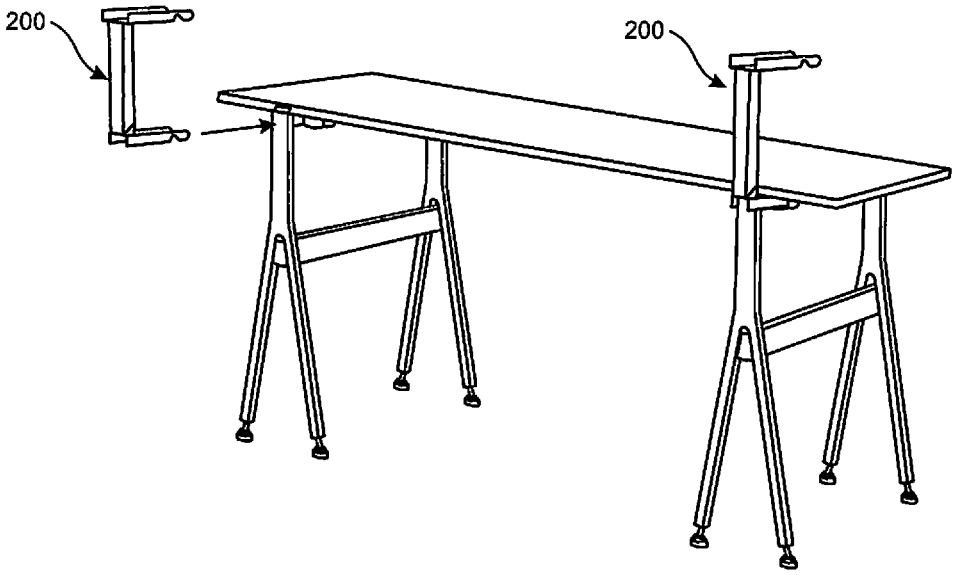
FIG. 3A is a perspective view of a modular apparatus with add-on brackets.
Figure 3B:
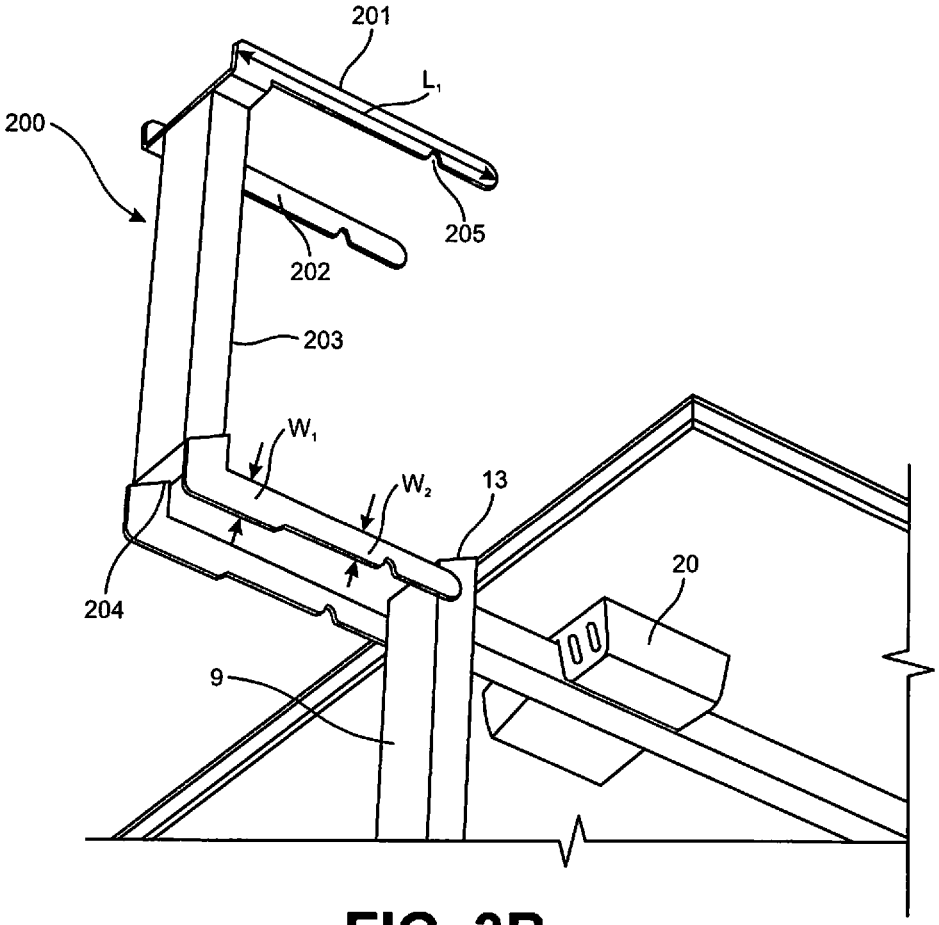
FIG. 3B is a perspective view of the engagement of a bracket with a connector.
Figure 9:
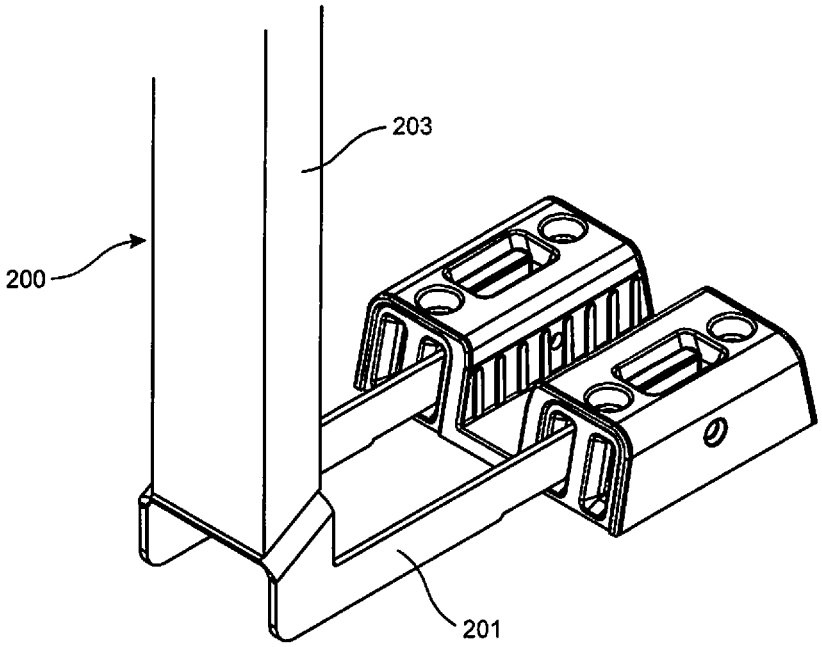
FIG. 9 is a perspective view of a connector with bracket partially engaged.

With reference to FIGS. 3A, 3B and 9, the slots may accommodate retention members. The modular apparatus may include add-ons or attachments to augment the modular apparatus and create a multitude of differing formations. While the overall structure of particular attachments may differ, the system is designed such that attachments may be connected to the modular apparatus by inserting retention members into the slots of the connectors. Alternatively, the attachments may themselves include retention members.

FIGS. 3A-3B depict a bar attachment 200, such as a shelf board arm or extension arm. The bar attachment 200 includes a plurality of retention members, e.g. 201. Essentially, the retention members are shaped bars that correspond to the slots of the connectors. The retention members slide within the slots 131 of the connectors. In one embodiment the retention members may include one or more notches 205 that may mate with one or more detents 153 within a slot. Alternately the retention member may include one or more protrusions or teeth that mate with a carved detent, or some combination thereof. The retention members are adapted to slide in and out of the connectors repeatedly and without the need for the use of additional tools. While the retention members, shown for example in FIG. 12, are relatively long and thin with rectangular cross section, it is contemplated that alternative shapes for retention members could be utilized. For example, the retention member could be cylindrical or conical and fit a circular slot, or triangular and fit a triangular slot.

As shown in FIG. 3B, the retention members have a length, for example L1 of retention member 201. The retention members also have a width and a thickness. In the embodiment shown, the length is greater than the width, and the width is greater than the thickness. In one embodiment, the width is variable along the length. For example, the width $W_2$ at the distal end of the retention member is less than the width $W_1$ at the proximal end of the retention member. It is contemplated that the width could vary continuously along the length or incrementally, though maintaining a single width $W_2$ along the majority of the portion of the retention member that fits within the slot assists in maintaining the proper, level orientation of the retention member when it is fully inserted. Increasing the width to $W_1$ near the proximal end enables the retention member to contact the inner diameter of the slot and frictionally engage the slot to prevent the retention member from inserting too far into the slot. In another embodiment, the retention member is provided with a protrusion to form a stop at the desired distance along its length. In another embodiment, a cylindrical or conical retention member may slide within a circular slot, and a portion of the retention member near the proximal end may step, or taper, out such that the proximal portion has a greater cross-sectional diameter than the cross-sectional diameter of the distal end. In one embodiment the width and thickness dimensions of the retention member is approximately equal to (though still slightly less than) the interior height and width of the slot such that the retention member fit snuggly within the slots and thus minimizes movement of the retention member within the slot.

Figure 4A:
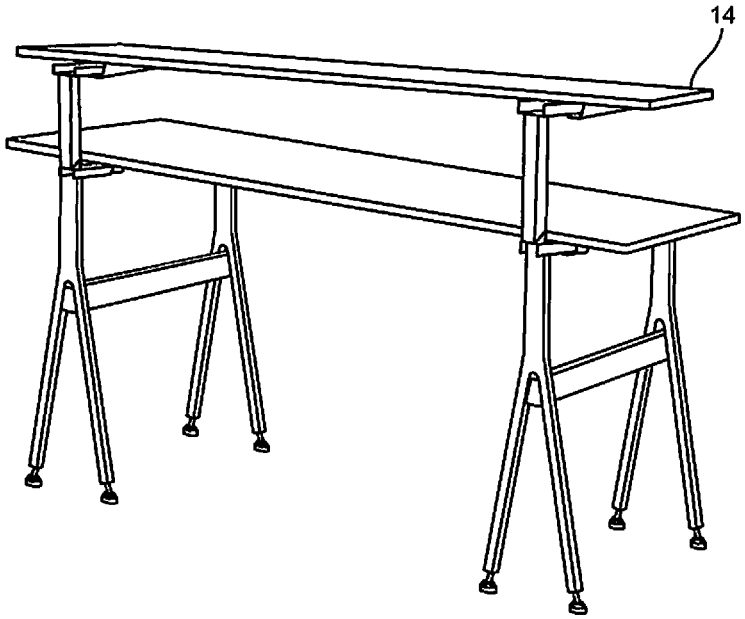
FIG. 4A is a perspective view of a modular apparatus with an additional add-on shelf.
Figure 4B:
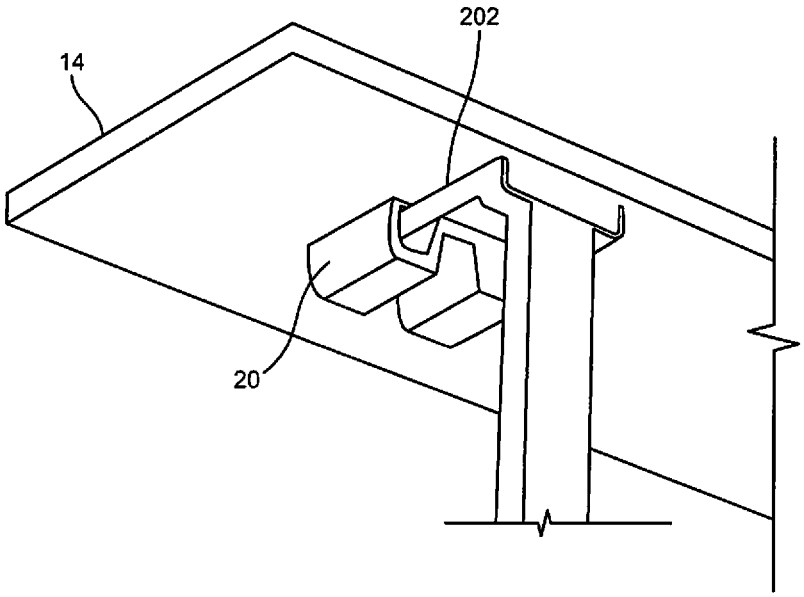
FIG. 4B is a perspective view of the engagement of a bracket with a connector of the shelf.
Figure 6:
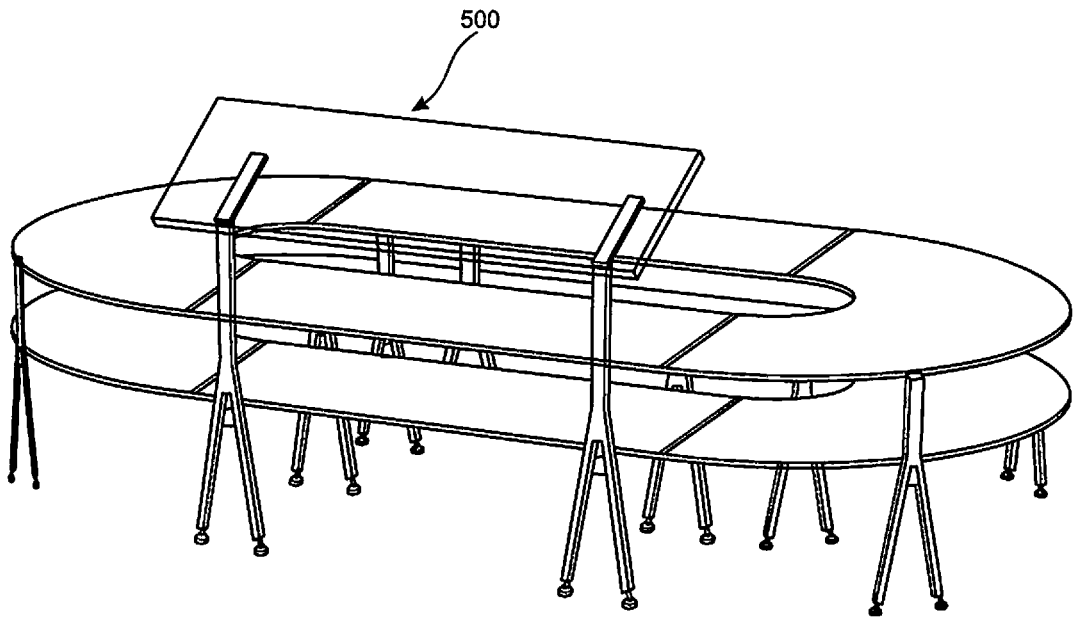
FIG. 6 is a perspective view of an embodiment of a modular apparatus in an alternative configuration.

The bar attachment 200 includes retention members are connected to a bar extension 203. The base 204 of the bar extension is formed to mate with the upper terminating portion 13 of the extension 9 of leg 1. In the embodiment depicted in FIG. 12, the base 204 and upper terminating portion 13 are each angled, though each could be flat or grooved. In one embodiment, each is grooved laterally across the width of the base and upper terminating portion such that when the surfaces are mated, the groves form additional detents to prevent the retention members from sliding out. The retention members may also be flared out to slide along the side of the extension 9 and prevent the bar attachment from twisting. In the embodiment of FIG. 3A-3B, retention members 201 and 202 are formed to mate with the connector of a second plank 14 as shown in FIG. 4A-4B. FIG. 6 is a depiction of sneeze In another embodiment, the connector is provided with holes 160 and 161, see FIGS. 7B and 7D, that traverse the width of the connector and provide a channel, such as a pinhole, through the connector where the pinhole channel connects holes 160 and 161. In such an embodiment, the channel may accommodate a pin, such as a cotter pin, or pin having a spring loaded retention ball, that slides through the pinhole and traverses the channel. The retention member may be inserted in the slots, and the pin may slide through the pinholes and though, for example notch 202 (FIG. 12) to securely hold the retention member in place.

Figure 5A:
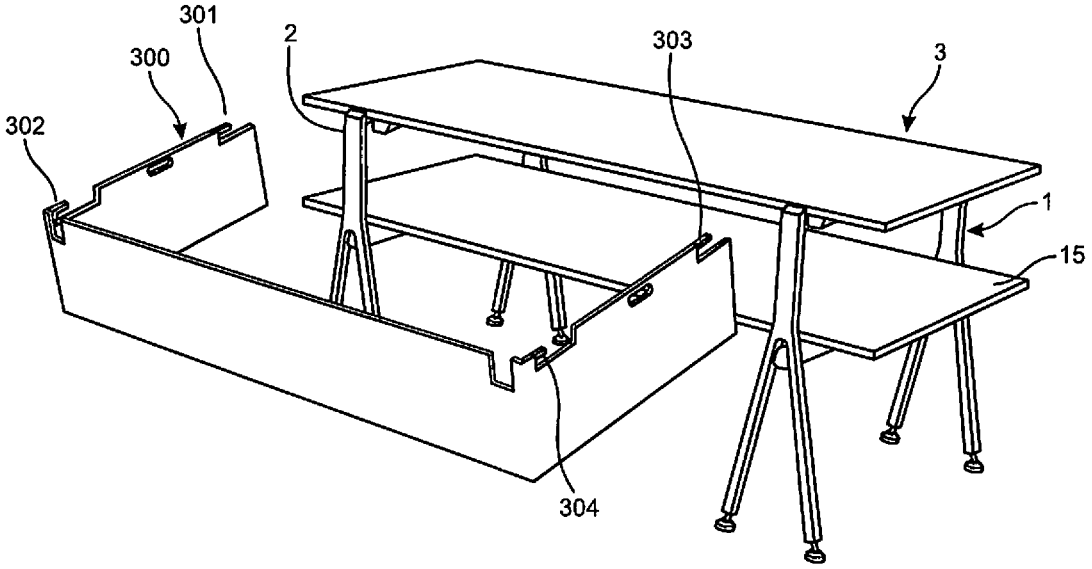
FIG. 5A is a perspective view of an embodiment of a modular apparatus with screen.
Figure 5B:
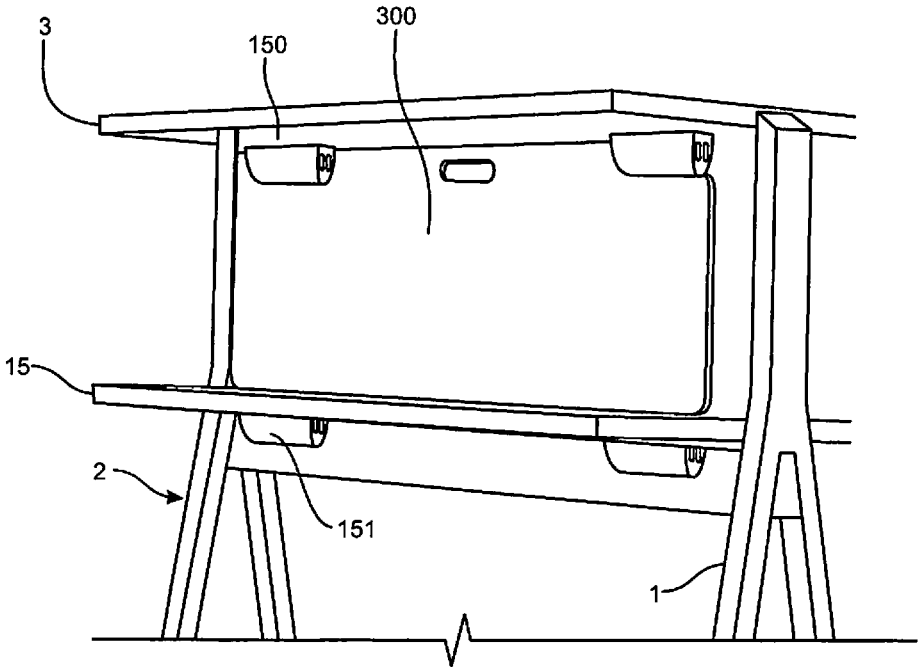
FIG. 5B is a perspective view of an embodiment of a modular apparatus with screen engaged with connectors.

Other attachments include covers. As shown in FIG. 5A-5B, the legs 1, 2 may be provided with planks 3, 15, such that connectors, e.g. 150, 151, fit over the cross pieces of the legs. The cover 300 is formed of one or more panels, each having a length and width and may include a plurality of retention members 301, 302, 303, 304 that each mate with one of the slots in each connector. The retention members may be separated by the lengths of the panels as shown, for example in FIG. 5A. Thus the hanging cover can be easily fitted to the modular apparatus and connected beneath the top plank 3 without tools, tape, glue or additional fasteners, leaving the top completely open for use. The hanging covers can also be easily removed without tools. The covers may be made of fabric, foam, wood, sheet metal, plastic, or other material. In a rigid foam embodiment, the cover is hinged (for example along the corners, and optionally along the center span for example) so that it is collapsible. The cover may also be fabric stretched over a frame that may be collapsible. Alternatively the covers could be loose fabric with the retention members affixed to the fabric at specific intervals so that the fabric may be stretched across the center and side spans and the retention members inserted into the slots of the connectors to hold the cover in place.

Multiple slots in the connectors allow for multiple attachments to be added to each leg. For example, a hanging cover may utilize one slot of each connector, and an extension bar that utilized two slots of a connector may also be added and used at the same time.

Other attachments include a handing rack or arm. The rack may be used to hang materials, signage, lights, or a curtain, for example. Other configurations include sneeze guard shielding 500 as shown in FIG. 6, or a signpost. The sneeze guard may be formed of a glass or Plexiglas shield that is connected to one or more attachment bars having retention members to hold the guard in place.

Utilizing separate leg portions enables the modular system to exhibit a plurality of different configurations. All manner of planks could be utilized and connected together to form different shapes. For example, FIG. 1 depicts a rectangular surface utilizing two legs. FIG. 7 depicts an oval surface utilizing eight legs. Alternatively planks could be shaped to make an octagonal surface utilizing four legs. Additionally, because the legs are interchangeable, in the event that a particular surface may experience a heavier than average load, additional legs may be provided to enhance the structural support for the plank. For example, a standard table as depicted in FIG. 1 may be provided with a third leg in the center to provide additional structural support, or third and fourth legs or more could be provided if necessary.

Although the present invention has been described in terms of various embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. An attachment for a modular apparatus comprising:

a plurality of retention members, each having a proximal end and a distal end where the proximal ends of the plurality of retention members are connected together but the distal ends of the plurality of retention members are separated from each other;

each of the plurality of retention members comprising:

a length and a width such that the length is greater than the width;

a notch formed in the width; and wherein the notch is formed on the same side of each width.

2. The attachment for a modular apparatus of claim 1, wherein the distal end of each retention member tapers and the width of each retention member varies along the length such that a portion of the retention member at the proximal end is wider than a portion of the retention member between the notch and point at which the distal end tapers.

3. The attachment for a modular apparatus of claim 2, wherein the width of the retention member on either side of the notch is equal and less than the width at the proximal end.

4. The attachment for a modular apparatus of claim 1 further comprising a bar having a base and a top opposite the base, a distance between the top and the base constituting a height and a distance perpendicular to the height constituting a bar width;

wherein the proximal ends of the plurality of the retention members are connected together by being connected to the base of the bar; and wherein the notches are formed parallel to the height of the bar.

5. The attachment for a modular apparatus of claim 4, further comprising a second plurality of retention members connected to the top of the bar, each of the second plurality of retention members comprising a proximal end connected to the top of the bar and a distal end wherein the distal ends of each of the second plurality of retention members are separated from each other.

* * * * *